United States Patent [19]

Stackhouse

[11] Patent Number: 4,471,977

[45] Date of Patent: Sep. 18, 1984

[54] FLEXIBLE FORM ASSEMBLY

[75] Inventor: Donald C. Stackhouse, Vandalia, Ohio

[73] Assignee: Harris Graphics Corporation, Melbourne, Fla.

[21] Appl. No.: 378,025

[22] Filed: May 13, 1982

[51] Int. Cl.[3] ..... B41L 1/14; B41L 1/32; B42D 13/00

[52] U.S. Cl. ..... 282/11.5 A; 281/38; 270/39

[58] Field of Search ..... 282/11.5 R, 12 R, 15 R, 282/18 R, 20 R, 21 R, 21 D; 270/39; 101/228; 281/38

[56] References Cited

U.S. PATENT DOCUMENTS

| | | | |
|---|---|---|---|
| 2,907,585 | 10/1959 | Sornberger et al. | 282/11.5 A |
| 3,228,710 | 1/1966 | Chodorowski | 281/38 |
| 3,503,629 | 3/1970 | Bash | 282/11.5 A |
| 3,727,908 | 4/1973 | Whitesell et al. | 270/39 |
| 3,806,165 | 4/1974 | Skees | 282/11.5 A |
| 3,843,113 | 10/1974 | Schaffer | 281/38 |
| 3,890,893 | 6/1975 | Kodis | 282/11.5 A |
| 4,108,352 | 8/1978 | Peschke | 282/11.5 A |
| 4,166,643 | 9/1979 | Fischlin | 282/11.5 A |
| 4,177,730 | 12/1979 | Schriber et al. | 101/228 |

OTHER PUBLICATIONS

The Business Forms Handbook, Second Edition, Copyright 1979, Published by the National Business Forms Asso.; pp. 121–123.

*Primary Examiner*—E. R. Kazenske
*Assistant Examiner*—Paul M. Heyrana, Sr.
*Attorney, Agent, or Firm*—Biebel, French & Nauman

[57] ABSTRACT

A multi-part form assembly, including a plurality of superimposed webs, is divided by cross perforations into a series of connected separable form parts, each web including at least one edge section defined by a longitudinal perforation extending lengthwise of the webs spaced inward from an edge of the webs and the edge sections has line holes therethrough. The improvement comprises the webs being connected at the edge sections by lines of adhesive arranged alternately on opposite sides of the line holes and each of the edge sections having pairs of nonintersecting cuts located on opposite sides of each hole. The cuts extend in one direction toward the next hole and in the opposite direction outward of the next hole, defining pairs of connecting strips which allow limited separation and flexing of the webs. Also disclosed are an apparatus and method of making such a form assembly.

3 Claims, 7 Drawing Figures

FLEXIBLE FORM ASSEMBLY

BACKGROUND OF THE INVENTION

Multiple form assemblies are fastened in one of two ways—through temporary fastenings or permanent fastenings, and the former are generally more flexible. This invention relates to a permanent fastening which has flexibility equivalent to a temporary fastening, allowing for movement between the form parts in some directions and yet securing the form parts together along one or both margins. Relative movement between the parts of the form has many advantages which cannot be met through the use of prior art of temporary or permanent fastenings.

The carbon and paper webs are interleaved and secured together in a collating machine which often uses glue for attaching. Glue lines or spots are usually placed within the perforated margin(s) and attach a web of paper to adjacent webs both above and below to form a web assembly. Once the webs are interconnected, a collating machine or other device may perforate the continuous web assembly in a transverse direction. The continuous assembly can be folded in a zig-zag pattern along the cross perforations to provide for subsequent feeding through various autographic register machines, printers, or other business machines, and also to achieve the most efficient box-like storage.

Although temporary fastenings can be utilized in the same manner, difficulties arise since the web assembly may only remain attached for a short time and subsequently may not perform well in use with a high speed business machine. Rigid fastenings, on the other hand, do not provide the needed flexibility between sheet faces. With the advent of "distributed data processing" (decentralized data processing) and the rapid growth of the small business computer there has come a need for a more "flexible" business form that operates well with the printers of such computer systems. Typically, these printers employ a small diameter roll or platen, which carries the form. Crimped forms because of the protruding "paper tails" tend to jam in such printers. Rigidly glued forms will not conform to the small diameter platen and have trouble advancing through the printers. The flexible form does conform to the platen and operates well in the printer.

SUMMARY OF THE INVENTION

The present invention encompasses an improved form, and a method and apparatus for producing a web assembly of such form, which provides greater flexibility between the form webs and sheets, while using a continuous adhesive connection. Pairs of non-intersecting cuts are made within the margins of the webs, with a cut line on either side of a feed hole. The cut lines extend in one direction in a converging fashion toward, but not touching, the adjacent feed hole, and, in the opposite direction, the lines are directed outward of the next hole. These cuts can be made on the forms press, or on the collator. In the collator the glue or adhesive is placed on opposite sides of the line holes and simultaneously opposite sides of the web. In this way, the top and middle webs are fastened on one side of the line holes while the middle and bottom webs are fastened on the opposite side of the line holes, and so on, in an alternating fashion throughout a web assembly of more than three sheets. Using this gluing pattern and utilizing the cut lines around each feed hole allows for the needed flexibility between the web sheets and yet retains the needed attachment strength between the sheets.

The flexibility objective of this invention prevents tenting, and minimizes machine clogging and/or misregistration, as well as assuring smoother feeding of the continuous web assembly through a printer. As the continuous sheets or webs proceed through various types of computer printers, autographic registers, or other business machines which use multi-part forms, the forms may pass over a platen and various sharp turns. The web alignment becomes distorted around these turns, particularly subjecting the outside part of the form assembly to severe strains. The flexibility allows slippage between the webs and yet retains enough connection strength to prevent the web assembly from disconnecting.

Other objectives and advantages of the present invention may become apparent through the following description of the drawings and preferred embodiments.

DESCRIPTION OF THE PREFERRED EMBODIMENTS

Figure 1:
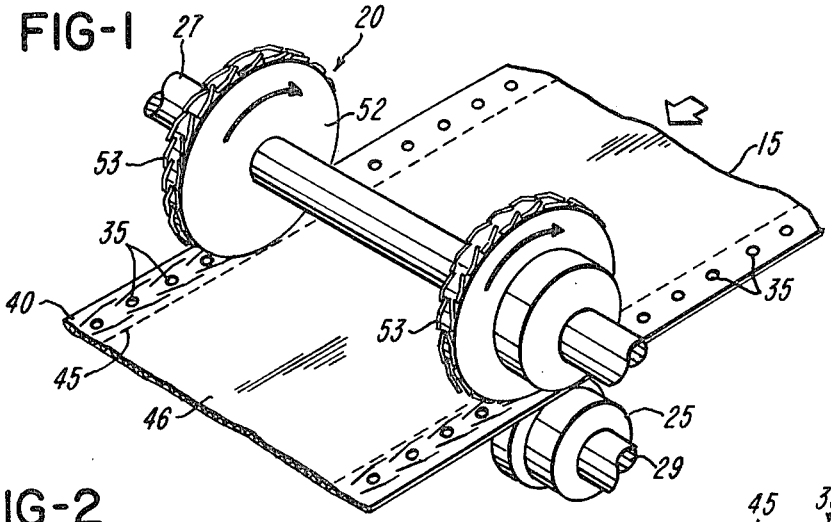
FIG. 1 is a perspective view of a web being cut in accordance with this invention.

FIG. 1 is a perspective view of the web cutting device which is part of the present invention. This device can be on a forms press, as a part of the web printing/processing steps, or one or more of them can be on a collator acting on desired webs before they are brought together. An individual web of paper 15 proceeds to the left as shown in FIG. 1 and passes between the cutting wheel 20 and the support or anvil wheel 25, which are mounted on shafts 27 and 29, respectively. As taught in U.S. Pat. No. 3,727,908, which describes a typical web collating machine, several carbon and paper webs are fastened in their marginal end sections 40 with an adhesive or glue.

Figure 2:
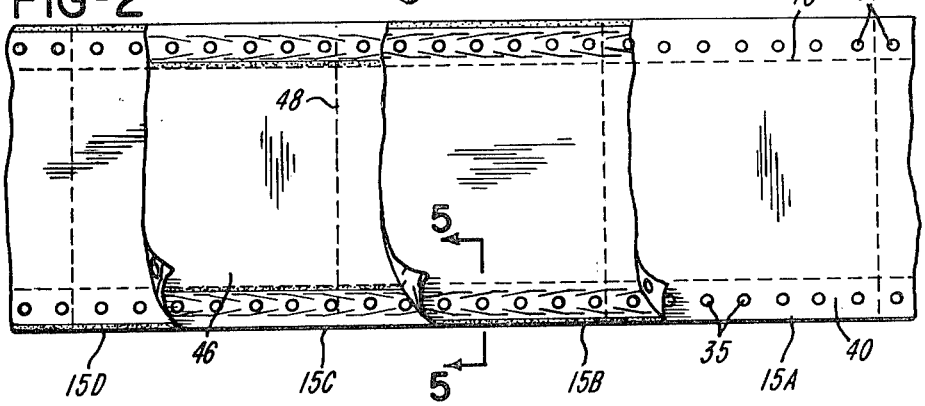
FIG. 2 is a fragmentary plan view illustrating the multiple parts of a multi-part form.

The flexibly fastened business form or web assembly of FIG. 2 consists of interleaved webs of paper 15A, 15B, 15C and 15D and carbon paper webs (not shown) in between, although it is understood that chemically treated paper (no carbon) which performs the same function as carbon paper may be substituted, as well as other equivalents. The webs proceed through the collator by means of one or more drive sprockets or tractor units (not shown) engaging with sprocket or feed holes 35 in the marginal edge sections 40 of the webs. The feed holes 35 pass through all the paper sheets so that the web assembly can proceed in an aligned registered manner through the machine, although the carbon webs (where used) may be of lesser width to end short of the marginal sections since accurate registration of the carbon webs is not essential.

Longitudinal perforations 45 that define the boundary of the marginal edge section 40 and the main sheet 46 allow an easy detachment of the edge section and feed holes from the main sheet 46 and also separation of the individual sheets from one another. Cross perforations 48 are made to assist in folding and separating or bursting the continuous web assembly.

Figure 3:
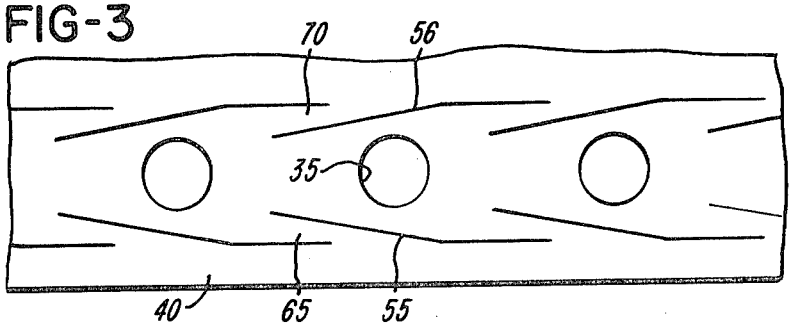
FIG. 3 is an enlarged view of the marginal end section of an intermediate sheet of a flexibly fastened business form, particularly illustrating the cutting pattern of the invention.

As shown in FIG. 1 of U.S. Pat. No. 3,727,908, paper and carbon sheets pass over rollers 30, past glue applicators 32, and to the feed belts 50. The present invention adds the cutting wheels 20 (FIG. 1) and corresponding support or anvil wheels 25 to the collating process before the sheets reach the glue applicators, as generally shown in said patent. The cutting wheel 20 includes a circular plate 52 containing knife-like projections 53 which are alternately spaced around the wheel, and there is a pair of such wheels for each intermediate web, e.g. webs 15B and 15C, but not the top and bottom (outside) webs 15A and 15D. The preferred embodiment utilizes a cutting wheel and corresponding anvil wheel along both marginal edge sections allowing the webs to connect on both edges. The spacing of the projections can vary so as to make a pair of cuts at each feed hole, at every other hole, or any other combination. The preferred embodiment uses the cutting pairs at each feed hole to assure even flexibility of the form. The projections are shaped in a manner to produce the cut lines shown in FIG. 3.

The anvil wheel 25 rotates on the opposite side of a web from a corresponding cutting wheel 20, to provide a stable surface for the cutting wheel 20 upon which to slice the paper. The widths of the cutting wheel 20 and the support wheel 25 are determined in accordance with the thickness of the marginal end section 40 and their rotation is governed by an appropriate connection of shafts 27 and 29 (not shown) to the drive gears of the collator.

The cutting wheel 20 strikes a pair of non-intersecting cuts 55, 56 through the sheets in a pattern that envelops a corresponding feed hole 35. The cut lines from both sides of the feed hole extend in one direction in a converging fashion toward the adjacent hole, and, in the opposite direction, the lines are directed outward of the next hole. This cutting pattern forms two spaced connecting strips 65 and 70, on opposite sides of the feed holes 35 and within the marginal end section. On adjacent webs the orientation of the cuts can be reversed (see FIGS. 2 and 4) to minimize the chance of the overlying cuts catching on each other.

Figure 4:
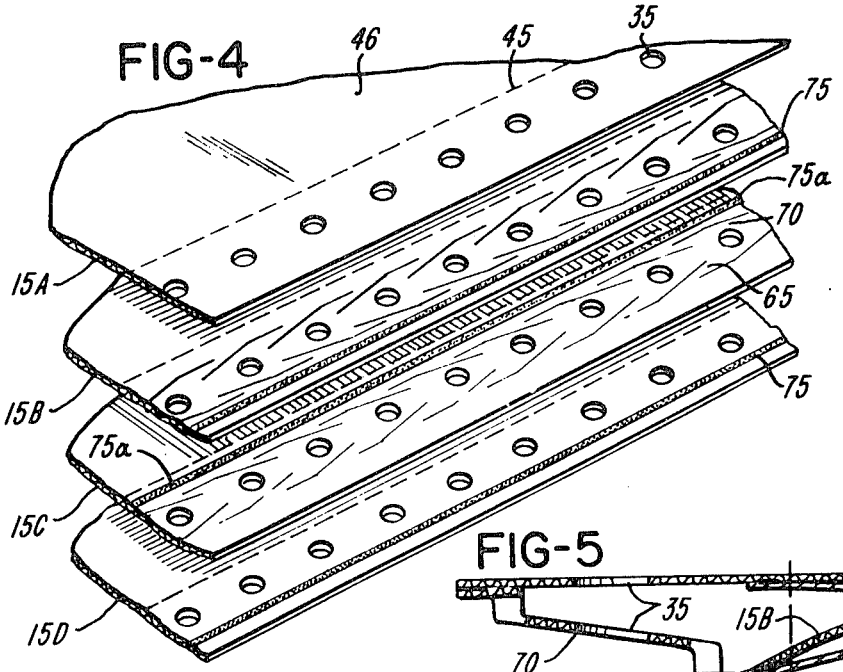
FIG. 4 is a perspective view of two spaced apart intermediate webs, showing the position of applied adhesive.

Once the webs have passed through the cutting wheels 20 they advance to the glue applicators, which will dispense spots, or lines, of glue 75 (FIG. 4) along the connecting strips to bond the webs together. The second uppermost web 15B will receive an appropriate glue or adhesive along the top surface of the connecting strip closest to the edge of the marginal end section as illustrated in FIG. 4. This adhesive 75 will attach the second web 15B with the top web 15A. The third web 15C will fasten with the second web's bottom surface by obtaining adhesive in an opposite position, i.e., glue **75*a* on the top surface of the third web 15C along the connecting strip nearest the longitudinal perforation. By alternating the adhesive application to the webs in this manner, all will be fastened together but can be separated within the limits of movement defined by the connecting strips 65, 70**.

Figure 5:
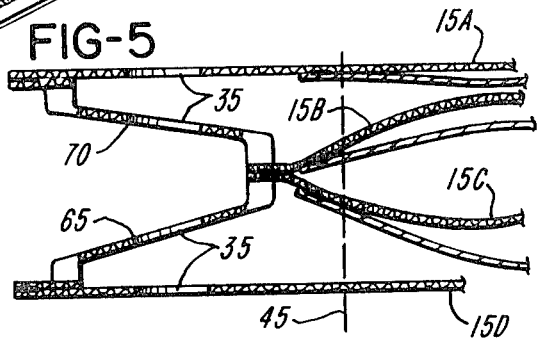
FIG. 5 is a cross-sectional view of a flexibly fastened business form along the line 5—5 of FIG. 2.
Figure 6:
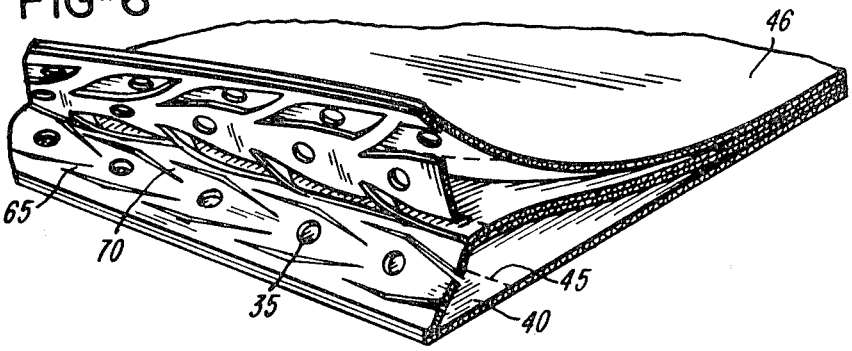
FIG. 6 is a perspective view of a flexibly fastened business form further illustrating the webbed connections of the invention.
Figure 7:
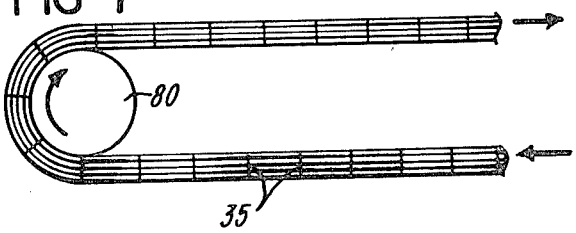
FIG. 7 is a side view showing a flexible multi-part form as it feeds around a roller, illustrating the relative movement between the webs or sheets as evidenced by the alignment of the feed holes.

The fastening pattern is clearly evident in FIGS. 5 and 6, which show a web assembly that is completely connected. Intermediate carbon sheets, which may or may not be used, are shown only in FIG. 5. The connecting strips 65, 70 formed by the pair of non-intersecting cuts 55, 60 allow a slight amount of movement between the webs, particularly in separating and/or lengthwise directions. This movement is vital when the web assembly is folded or utilized in a business machine. Free longitudinal motion prevents the webs from ridging and clogging a business machine while the connecting strips 65, 70 are distorted out of the plane of the webs. FIG. 7 illustrates that, once the stress is released, as when a fastened business form feeds around a roller 80, the connecting strips will bring the webs back into alignment so the feed holes 35 match up or register in a vertical direction. This assures drive sprocket engagement with the whole web assembly. The connecting strips thus provide a loose connection of the webs, yet retain enough strength to keep the sheets aligned when they are to be engaged with drive sprockets.

As previously mentioned, the cutting and anvil wheels can be added to a forms press. A typical press is shown in U.S. Pat. No. 4,177,730 of Dec. 11, 1979. The wheels can be added in the punch or perforation/slitter sections, as desired.

While the method herein described, and the form of apparatus for carrying this method into effect, constitute preferred embodiments of this invention, it is to be understood that the invention is not limited to this precise method and form of apparatus, and that changes may be made in either without departing from the scope of the invention which is defined in the appended claims.

What is claimed is:

1. In a multi-part form assembly including a plurality of superimposed webs divided by cross perforations into a series of connected separable form parts, there being a top web and a bottom web and at least one intermediate web, said webs each including at least one edge section extending lengthwise of the webs and having aligned line holes therethrough, the improvement comprising said webs being connected at said edge sections by lines of adhesive extending lengthwise of the webs and arranged alternately on successive web edge sections on opposite sides of said line holes, each of said edge sections having pairs of non-intersecting cuts located on opposite sides of each hole and extending in one direction toward the next hole and in the opposite direction outward of the next hole defining pairs of connecting strips which allow limited separation and flexing of the webs.

2. In a multi-part form assembly including a plurality of superimposed webs divided by cross perforations into a series of connected separable form parts, said webs each including at least one edge section defined by a longitudinal perforation extending lengthwise of the webs spaced inward from an edge of the webs, said edge sections having line holes therethrough, the improvement comprising said webs being connected at said edge sections by lines of adhesive arranged on successive webs in alternate fashion on opposite sides of said line holes, each of said edge sections having pairs of non-intersecting cuts located on opposite sides of each hole and extending in one direction toward the next hole and in the opposite direction outward of the next hole defining pairs of connecting strips which allow limited separation and flexing of the webs.

3. The method of flexibly connecting top, bottom, and intermediate superimposed webs which make up connected multi-part forms, said webs each having edge sections with registering feed holes therethrough to accommodate a feed mechanism, forming in each intermediate web pairs of non-intersecting cuts located on opposite sides of the feed holes, said cuts being greater in length than the center-to-center spacing of adjacent holes and being lesser in length than the center-to-center spacing between every other hole, each said pair of cuts converging toward an adjacent hole so as to extend inwardly of the next pair of cuts thereby defining connecting strips, and bringing all of the webs into superimposed relation with the feed holes aligned while adhesively connecting each intermediate web to an adjacent web along a line of attachment extending lengthwise of said edge section to one side of said cuts, the lines of attachment on the top and bottom of each intermediate web being located on alternate sides of said cuts.

* * * * *